US005308263A

United States Patent [19]

Noorily et al.

[11] Patent Number: 5,308,263

[45] Date of Patent: May 3, 1994

[54] HOLD-DOWN BRACKET FOR AN ELECTRICAL TERMINAL BLOCK

[75] Inventors: Peter Noorily, Bridgewater; Sidney Levy, Belle Mead, both of N.J.

[73] Assignee: Thomas & Betts Corporation, Memphis, Tenn.

[21] Appl. No.: 998,719

[22] Filed: Dec. 30, 1992

[51] Int. Cl.[5] ..... H01R 13/73

[52] U.S. Cl. ..... 439/570; 248/316.7

[58] Field of Search ..... 439/570, 571; 248/316.7; 24/702

[56] References Cited

U.S. PATENT DOCUMENTS

| | | | |
|---|---|---|---|
| 3,231,951 | 2/1966 | DeArmond | 248/316.7 |
| 4,605,815 | 8/1986 | Wilson | 174/41 |
| 4,993,966 | 2/1991 | Levy | 439/411 |
| 5,101,079 | 3/1992 | Rodrigues et al. | 174/65 |

*Primary Examiner*—Gary F. Paumen

*Attorney, Agent, or Firm*—Robert M. Rodrick

[57] ABSTRACT

A hold-down bracket secures an electrical terminal block to an enclosure surface. The terminal block includes a base having a plurality of circular terminal modules extending upwardly therefrom. The connector modules are arranged in plural staggered rows. Adjacent modules define a longitudinal passage therebetween. The bracket includes an elongate body having a securement element at one end for mechanical securement to the enclosure surface and an elongate terminal block holding member at the other end for positioning within the passage defined between adjacent terminal modules. The terminal block holding member has outwardly diverging opposed curved sidewalls preventing lateral withdrawal of the holding member through the passage. The mounting bracket may be supported at various locations along the terminal block to facilitate mounting to the enclosure surface.

8 Claims, 3 Drawing Sheets

HOLD-DOWN BRACKET FOR AN ELECTRICAL TERMINAL BLOCK

FIELD OF INVENTION

The present invention relates generally to an electrical terminal block supported within a terminal block enclosure. More particularly, the present invention relates to a mounting or hold-down bracket for supporting the electrical terminal block to an interior surface of the enclosure.

BACKGROUND OF THE INVENTION

In order to provide telephone service for local distribution (such as an individual home) it is necessary to tap into a multiconductor telecommunications cable. Currently the telephone industry uses terminal blocks which permit the connection of conductors of the multiconductor telecommunications cable to drop wires which establish electrical service directly to local distribution.

One example of a type of terminal block which may be used in the telecommunications industry for establishing telephone service is shown in U.S. Pat. No. 4,993,966, issued Feb. 19, 1991 to Levy entitled "Electrical Connector Block", which is incorporated by reference herein for all purposes. As shown in FIGS. 1 and 2 herein, terminal block 10 is used to connect drop wire 12 to a stub cable 14. The stub cable 14 is connected to a multiconductor telecommunications cable (not shown), while the drop wires 12 lead to the individual subscriber premises.

Terminal block 10 includes an elongate housing 16, typically formed of molded plastic. Housing 16 is generally rectangular in shape, having an elongate planar surface 18 and a depending perimetrical skirt 20 thereabout. Planar surface 18 includes a plurality of circular apertures 22 extending therethrough. Apertures 22 are positioned in two staggered longitudinally extending rows. An annular wall 24 extending upwardly from planar surface 18 surrounds each circular aperture 22.

Housing 16 further supports in each circular aperture 22 an electrical terminal module 30. Electrical connection is established between stub cable 14 and drop wire 12 using terminal module 30. Terminal module 30 supports first and second electrical connection elements 31, portions of which extend above and below planar surface 18, in a manner fully described in the ,966 patent In order to protect the connection of stub cable 14 to terminal modules 30, the rear of housing 16 is filled with a self-hardening insulating medium or potting compound 25. This potting compound 25 is poured in a liquid state into the inverted housing 16 and is then left to cure or harden, completely encapsulating the connection of stub cable 14 to terminal modules 30.

The terminal block 10 may then be supported in an appropriate enclosure which suitably protects terminal block 10 from the outdoor environment. One such enclosure used for mounting the terminal block to a utility pole is shown in U.S. Pat. No. 5,101,079. Another enclosure which is used to suspend the terminal block from overhead telecommunication cables is shown in U.S. Pat. No. 4,605,815.

In order to secure terminal block 10 to a flat surface of either enclosure, it is necessary to include mounting apertures 32 and 34 in terminal block 10 to permit insertion of a screw or other fastening member which securely attaches the terminal block to a surface of the enclosure.

While adequately providing securement for such terminal blocks, apertures 32 and 34 placed in the housing 16 are required to be blocked or otherwise damned to prevent the aperture from being filled by potting compound 25 when it is poured into inverted housing 16. This necessitates more complicated and expensive tooling for forming housing 16. Also, once the aperture are placed in a given position on terminal block 10 may be attached to a surface of the enclosure.

It is desirable to provide simplified mounting hardware which will permit more efficient mounting of an electrical terminal block to a surface of a terminal block enclosure.

SUMMARY OF THE INVENTION

It is an object of the present invention to provide a mounting bracket for securing an electrical terminal block to an enclosure surface.

It is a further object of the present invention to provide a hold-down bracket which is mechanically secured to the enclosure surface and is supported on the terminal block.

In the efficient attainment of these and other objects, the present invention provides a hold-down bracket for securing an electrical terminal block to an enclosure surface. The terminal block includes a base having a plurality of circular terminal modules extending upwardly therefrom and arranged in plural staggered rows. The adjacent modules define longitudinal passages therebetween. The bracket further comprises an elongate body having a securement member at one end which is mechanically secured to the enclosure surface and an elongate terminal block support member at the other end for positioning within the passage between adjacent terminal modules. The terminal block support member has outwardly diverging opposed curved sidewalls, preventing withdarwal of the support member through the passage.

As more particularly described by way of preferred embodiment herein, the curved sidewalls of the hold-down bracket have a radius of curvature, which is similar to the radius of curvature of the terminal modules. This permits the support member to be inserted between adjacent terminal modules from above and prevents the lateral withdarwal of the support member through the passage.

DETAILED DESCRIPTION OF THE PREFERRED EMBODIMENT

Figure 3:
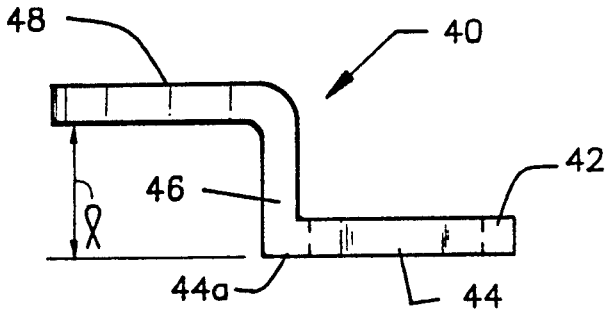
FIGS. 3 and 4 are side-elevational and top-plan views respectively of the hold-down bracket of the present invention.
Figure 4:
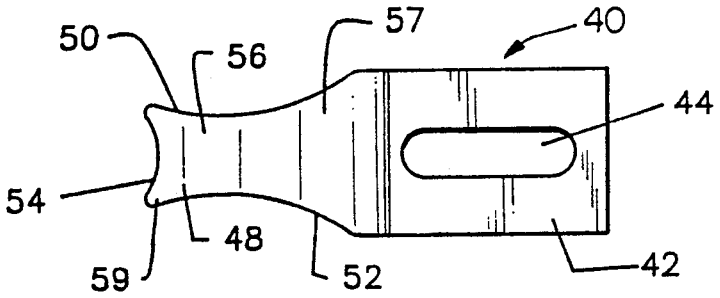

Referring to FIGS. 3 and 4, the hold-down bracket of the present invention is shown. Hold-down bracket 40 is an elongate metallic member having a securement end 42 which is provided for mechanical securement to a surface of an appropriate enclosure, which will be described in further detail hereinbelow. Securement end 42 includes an elongate aperture 44 therethrough, which permits accommodation of appropriate mounting hardware, such as a screw (FIG. 6), so as to secure securement end 42 to the enclosure surface. While an elongate screw receiving aperture 44 is shown, any appropriate mounting mechanism may be provided which will cooperate with the surface of the enclosure to suitably mechanically secure bracket 40 thereto.

Figure 1:
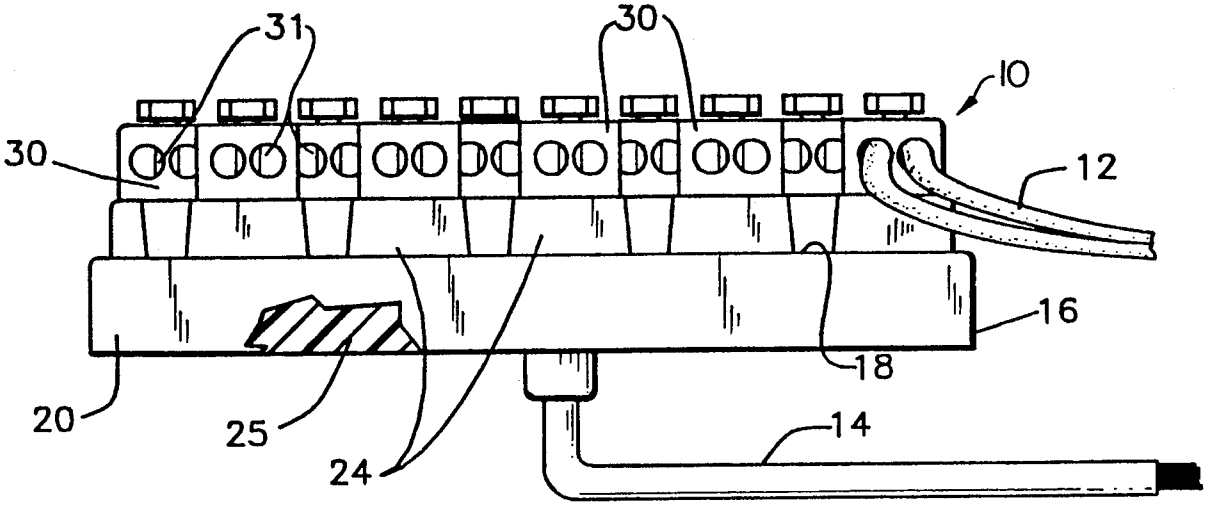
FIG. 1 is a side-elevational showing of an electrical terminal block of the type which may be used with the hold-down bracket of the present invention.

Bracket 40 further includes a central vertical transition portion 46, adjacent proximate extent 44*a* of securement end 42. Transition portion 46 extends upwardly from securement end 42, a length 1, so as to accommodate the vertical extent of depending skirt 20 of terminal block 10 as shown in FIG. 1.

Figure 2:
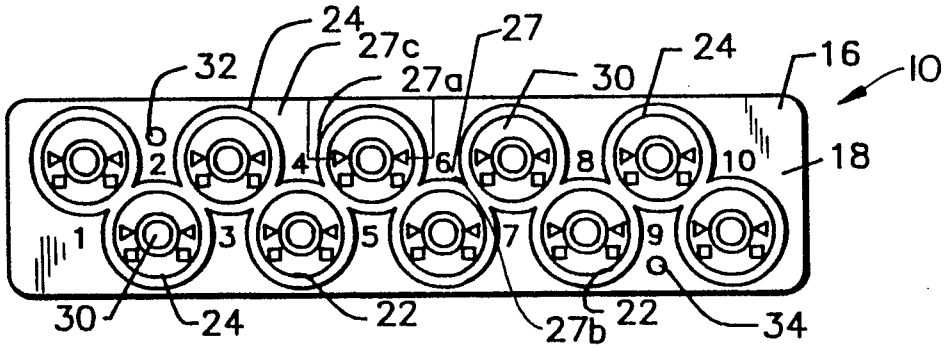
FIG. 2 is a top-plan view of the electrical terminal block of FIG. 1, including a stub cable and drop wires connected thereto.

Extending outwardly from transition portion 46, hold-down bracket 40 includes terminal block holding member 48. Holding member 48 is in the form of an elongate tongue having a pair of curved sidewalls 50 and 52 and a curved transverse endwall 54. As shown in FIG. 2, upwardly extended annular walls 24 of terminal block 10 form a passage 27 between adjacent walls 24. Each passage is bounded on three sides by wall 24. Thus, passage 27 has an hour-glass configuration with a narrow central section 27*a* and wider lateral section 27*b* and 27*c* on each side thereof. Sidewalls 50 and 52 of holding member 48 are curved such that holding member 48 has a narrow central section 56 and wider opposed lateral sections 57 and 59, which are configured in a manner closely conforming to the shape of passages 27 of terminal block 10. Thus, when inserted into passage 27, holding member 48 is captively retained therein.

Figure 5:
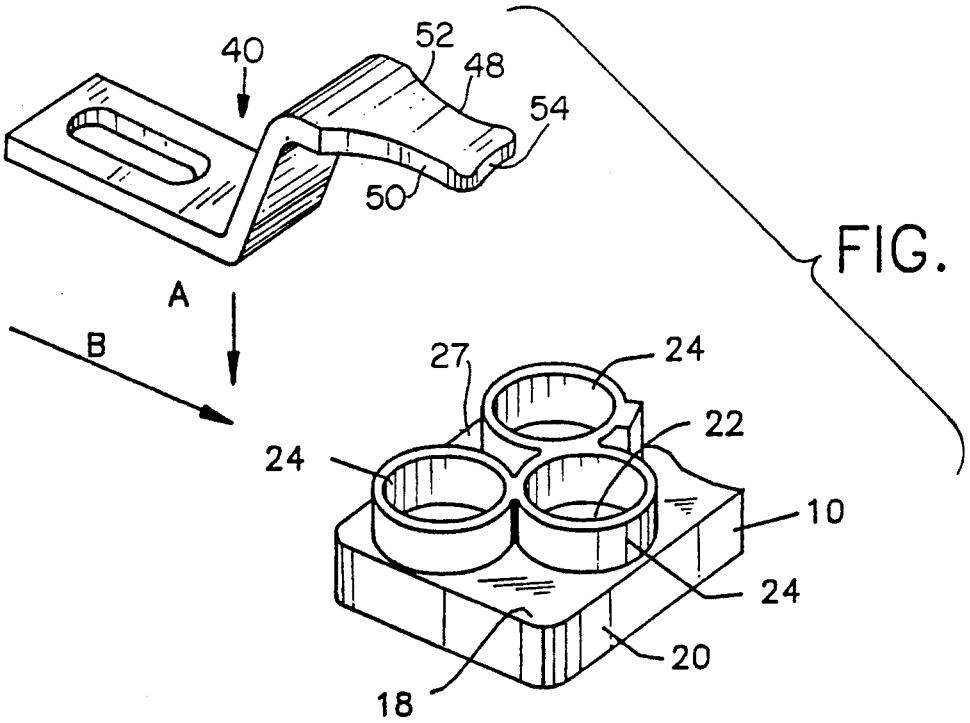
FIG. 5 is a fragmented showing of the terminal block of FIGS. 1 and 2 with the hold-down bracket of FIGS. 3 and 4 shown thereabove.
Figure 6:
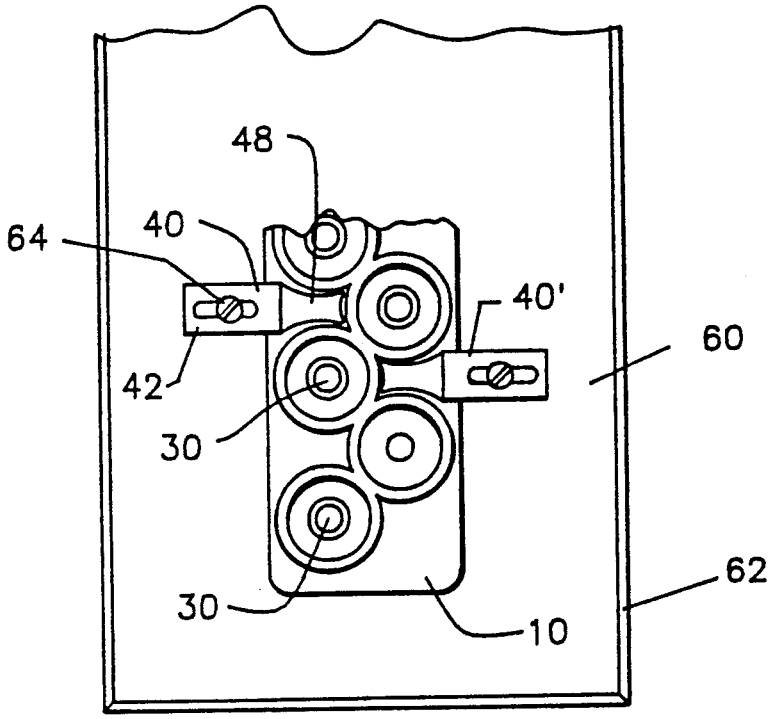
FIG. 6 shows partially broken away the terminal block of FIG. 1 mounted to an electrical enclosure surface using the hold-down bracket of FIGS. 3 and 4.

Referring to FIGS. 5 and 6, use of bracket 40 to secure terminal block 10 may be shown. As shown in FIG. 5, bracket 40 is positioned over terminal block 10 so that holding member 48 is positioned between any two adjacent terminal modules. For clarity, terminal modules 30 are shown removed from terminal block 10. Thus, bracket 40 is shown being positioned between adjacent circular upwardly extending annular walls 24. Holding member 48 of bracket 40 is configured so as to fit within the passage 27 created between adjacent annular walls 24 and lie against planar surface 18. Curved sidewalls 50 and 52 as well as curved endwall 54 have a radius of curvature which is substantially similar to the radius of curvature of the annular walls 24 (and thereby also the radius of curvature of terminal modules 30 supported therein) so that once bracket 40 is inserted from above in the direction of arrow A the bracket 40 can not be pulled laterally through passage 27 in the direction of arrow B. Curved sidewalls 50 and 52 are configured so that endwall 54 has a transverse dimension which is wider than the narrow central portion 56 and, therefor, narrower than the narrow central portion 27*a* of passage 27. This prevents such lateral removal of bracket 40.

Referring in more detail to FIG. 6, once bracket 40 is inserted downward between adjacent terminal modules 30, securement end 42 is placed against a planar surface 60 of an enclosure 62. Surface 60 may include plural threaded apertures (not shown) which accommodate a screw 64 or other fastening member to secure securement end 42 to surface 60.

Additional hold-down brackets 40' may be used in a similar manner along terminal block 10 to firmly secure block 10 to surface 60 of enclosure 62. Since hold-down bracket 40 may be used between any two adjacent terminal modules 30, there is no need to provide preconfigured securement openings in block 10. Further, the number of brackets 40 employed in each installation may vary depending on the size of terminal block 10 and the location in which the terminal block is mounted. Additionally, since bracket 40 may be used at various locations along terminal block 10, matching the bracket with mounting apertures placed in surface 60 of enclosure 62 is more expedient as bracket 40 can be easily relocated along terminal block 30.

Various changes to the foregoing described and shown structures would now be evident to those skilled in the art. Accordingly, the particularly disclosed scope of the invention is set forth in the following claims.

We claim:

1. A hold-down bracket for securing an electrical terminal block to an enclosure surface, said terminal block including a base having a plurality of circular terminal modules extending upwardly therefrom and arranged in plural staggered rows, adjacent modules defining a longitudinal passage therebetween, said bracket comprising:

an elongate body having securement means at one end for mechanical securement to said enclosure surface and an elongate terminal block support member at an other end for positioning from above within said passage between said adjacent terminal modules, said terminal block support member having outwardly diverging opposed curved sidewalls preventing lateral withdrawal of said support member through said passage wherein said support member includes a curved transverse endwall between said outwardly diverging sidewalls, said curved endwall having a radius of curvature substantially similar to said radius of curvature of said terminal modules.

2. A hold-down bracket in accordance with claim 1 wherein said curved sidewalls of said support member have a radius of curvature which is substantially similar to the radius of curvature of said terminal modules.

3. A hold-down bracket in accordance with claim 1 wherein said securement means includes an aperture through said one end and a fastening element for fastening said one end to said enclosure surface.

4. An electrical terminal block assembly for support within an electrical enclosure comprising:

an elongate terminal block housing having a raised planar surface including a plurality of openings therethrough arranged in plural staggered rows and a perimetrical sidewall extending from said planar surface forming a bounded chamber;

plural terminal modules extending through said openings, said modules having first electrical connection means above said planar surface and second electrical connection means extending below said surface and into said bounded chamber;

a cured potting compound filling said chamber and covering said second electrical connection means; and a hold-down bracket for supporting said terminal block against a surface of said enclosure, said hold-down bracket including an elongate body having securement means at one end thereof for mechanical securement to said surface of said enclosure and terminal block holding means at said other end for supporting said terminal block with respect to said enclosure surface, said holding means further including an elongate tongue configured to be inserted from above between adjacent terminal modules, said tongue having a widened end portion preventing lateral withdrawal of said tongue from between said terminal modules.

5. A connector block assembly of claim 4 wherein said terminal modules are circular and adjacent modules form a passage therebetween having an hour-glass configuration.

6. A connector block assembly of claim 5 wherein said tongue has an hour-glass configuration for positioning within said passage between said adjacent modules.

7. A connector block assembly of claim 6 wherein said tongue position and said one end are non-coplaner.

8. A connector block assembly of claim 7 wherein said mounting bracket includes a transition portion between said one end and said tongue, said transition portion having a length which is substantially similar to the length of said perimetrical skirt of said terminal block.

* * * * *